United States Patent [19]

Bleuer

[11] Patent Number: 4,778,295

[45] Date of Patent: Oct. 18, 1988

[54] KEYBOARD WITH ELONGATE KEYS ASSOCIATED WITH COMPACT SWITCH MECHANISMS

[76] Inventor: Keith T. Bleuer, 1663 Wilshire Dr. NE., Rochester, Minn. 55904

[21] Appl. No.: 624,457

[22] Filed: Jun. 25, 1984

[51] Int. Cl.[4] ..... B41J 5/28; B41J 5/10; B41J 5/12

[52] U.S. Cl. ..... 400/485; 400/489; 400/490; 200/339

[58] Field of Search ..... 400/490–495.1, 400/472, 473, 482–489; 84/433; 235/145 R; 340/365 R; 200/5 R, 5 A, 339

[56] References Cited

U.S. PATENT DOCUMENTS

| | | | |
|---|---|---|---|
| 1,652,464 | 12/1927 | Tyberg . | |
| 2,187,592 | 1/1940 | Paul . | |
| 2,408,452 | 10/1946 | Stixrud . | |
| 2,449,126 | 9/1948 | Kirkpatrick | 400/485 |
| 3,667,787 | 6/1972 | Semour | 400/492 X |
| 3,929,216 | 12/1975 | Einbinder | 400/492 X |
| 4,029,915 | 6/1977 | Ojima | 400/485 X |
| 4,449,839 | 5/1984 | Bleuer | 400/485 |

OTHER PUBLICATIONS

Montgomery, "Bringing Manual Input into the 20th Century", *Computer* magazine; pp. 11–18; Mar. 1982.

*Primary Examiner*—Clifford D. Crowder

[57] ABSTRACT

A keyboard having ten elongate keys extending in a row substantially at right angles to a transverse centerline through the keys with each of the keys having a longitudinal trough on its upper surface defined by three recesses extending longitudinally of the key, with the sides of the recesses of adjacent edges of the fourth and fifth keys and of the sixth and seventh keys being reduced in height so as to facilitate movement of the index fingers from the fourth to the fifth key and from the seventh to the sixth key. Each of the elongate keys actuates three switches depending into which of the three recesses of the key a finger is applied, and the elongate key of one form of the invention is formed by a central relatively short auxiliary key and a long auxiliary key on its opposite ends, with these being articulated. Switch mechanism actuated by the key includes three plates in face-to-face contact. The short auxiliary key is fixed on a third one of the plates which is constrained to be strictly reciprocative, and the long auxiliary key is fixeid on the second of the plates which is reciprocative and is also swingable and is disposed between the first and third plates. The first plate is fixed and constitutes a supporting plate. The second plate carries a switch actuating pin which actuates various different switches depending on the swing given this second plate. A second embodiment of the switch mechanism includes the fixed first plate and also includes second and third plates. In this case, the third plate is between the first and second plates and is strictly reciprocative, and the second plate is reciprocative and also is swingable. The second plate carries a switch actuating pin. The elongate key in this case is integral end-to-end and has the second plate fixed to it. The third plate has a pair of spaced rounded supporting edges on which the elongate key may swing.

24 Claims, 5 Drawing Sheets

KEYBOARD WITH ELONGATE KEYS ASSOCIATED WITH COMPACT SWITCH MECHANISMS

BACKGROUND OF THE INVENTION

The invention relates to keyboards and more particularly to keyboards having elongate keys and still more particularly to electrical switch mechanisms operated by such keys.

I have previously proposed, in my prior U.S. Pat. No. 4,449,839 issued May 22, 1984, a keyboard with elongate integral keys each of which has a longitudinal row of three finger receiving recesses and actuating switch mechanism so that, when the key is depressed using the central recess, one switch is actuated; while, if the two end recesses are used, a pair of other switches are actuated respectively. The switch mechanism for each of the keys includes a cylindrical plunger about which a return spring is disposed and swingingly mounting the key and a pair of contacting plate portions on one side of the plunger one of which is fixed and the other of which carries a switch actuating pin for actuating three different switches depending on whether the key is depressed without swinging motion or with swinging motion in opposite directions.

SUMMARY OF THE INVENTION

It is an object of the present invention to provide an improved simplified electrical switch mechanism utilizable in connection with elongate finger operated keys at least parts of which are swingable in accordance with finger pressure applied adjacent opposite ends of the elongate keys.

More particularly, it is an object of the invention to provide supporting structure for such an elongate key which includes three plates in face-to-face contact a first one of which is fixed, a second of which is downwardly reciprocative with or without accompanying swinging motion along with a part of the key and the third of which is strictly downwardly reciprocative along with another part of the key, with the second plate carrying a switch actuating pin that actuates any of three switches depending on whether the second plate is simply reciprocated or is reciprocated with accompanying swinging motion in one or the other direction.

It is another object of the invention to provide an improved keyboard utilizing a series of elongate keys with a longitudinal row of three finger receiving recesses formed on the upper surface of each key. It is contemplated that the keyboard shall have ten such elongate keys utilizable with the four fingers of the two hands and with the adjacent edges of the fourth and fifth keys reduced in height so as to facilitate the movement of the index finger of the left hand from the fourth key to the fifth key and with likewise reduced height of adjacent edges of the sixth and seventh keys to facilitate the movement of the index finger of the right hand from the seventh key to the sixth key when desired.

In one form of the invention, the elongate key is formed by a central short auxiliary key and a long auxiliary key extending from the short key in opposite directions and articulated with the short key. The long auxiliary key carries a second one of a series of three plates which is centrally disposed in the series of three plates, between a first fixed plate on one side and third strictly reciprocative plate on the other side. The second, central plate is mounted to be swingable along with the long auxiliary key and carries a pin actuating one switch when the central plate moves downwardly without swinging motion and actuating two other switches when this plate is moved downwardly with accompanying swinging motion in opposite directions. The third plate on the side of the swingable plate opposite from that of the fixed plate is fixed to the short auxiliary key to move downwardly with it. A rivet fixed with respect to the second plate connects the second and third plates together so that downward movement of the short auxiliary key moves the second plate downwardly to actuate a switch, and the connection between the second and third plates includes diverging edges formed on the third plate which wedge on and grip the cylindrical shaft of the rivet so as to prevent undesired swinging motion of the long auxiliary key when finger pressure is applied on the short auxiliary key for depressing this key. A return spring is mounted in windows in the three plates that are substantially in register and is effective between an upper abutment edge formed on the second plate and an abutment edge formed on the first, fixed plate so that the spring is effective to return the parts to their original positions when finger pressure is released from the elongate key and for acting as a restraint so that the diverging edges formed on the third plate are effective in their wedging action.

In a second embodiment of the invention, the first, fixed plate again is on one side of the series of three plates; and in this embodiment the second, swinging plate is mounted at the other side of the third, central plate which is in the middle between the first and second plates and is purely reciprocative. The elongate controlling key is integral end-to-end; and the second, swingable plate is fixed with respect to the elongate key. The second, swingable plate has a switch actuating pin fixed with respect to it which extends through an accommodating slot in the third, middle reciprocative plate. The third plate mounts the elongate key on a pair of spaced, rounded edges so that when a central recess of the elongate key has finger pressure applied in it, the second and third plates move downwardly without swinging motion of the second plate so that the pin actuates a first switch. The rounded edges allow swinging motion of the elongate key along with the second plate as the key is depressed by finger pressure applied in recesses thereof adjacent opposite ends, and under these conditions the pin moves into actuating positions with respect to second and third switches.

It is another feature of the invention to provide each of the elongate keys with an elongate trough extending longitudinally on the upper surface of the key, with the bottom of the trough being formed by three finger receiving recesses on the upper surface of the key and with the adjacent edges of the fourth and fifth keys in a series of ten keys being reduced in height to facilitate the movement of the index finger of the left hand from the fourth key to the fifth key and with the height of the adjacent edges of the sixth and seventh keys being reduced so as to likewise facilitate the movement of the index finger of the right hand from the seventh key to the sixth key.

BRIEF DESCRIPTION OF THE CRAWINGS

DESCRIPTION OF THE PREFERRED EMBODIMENTS

Figure 1:
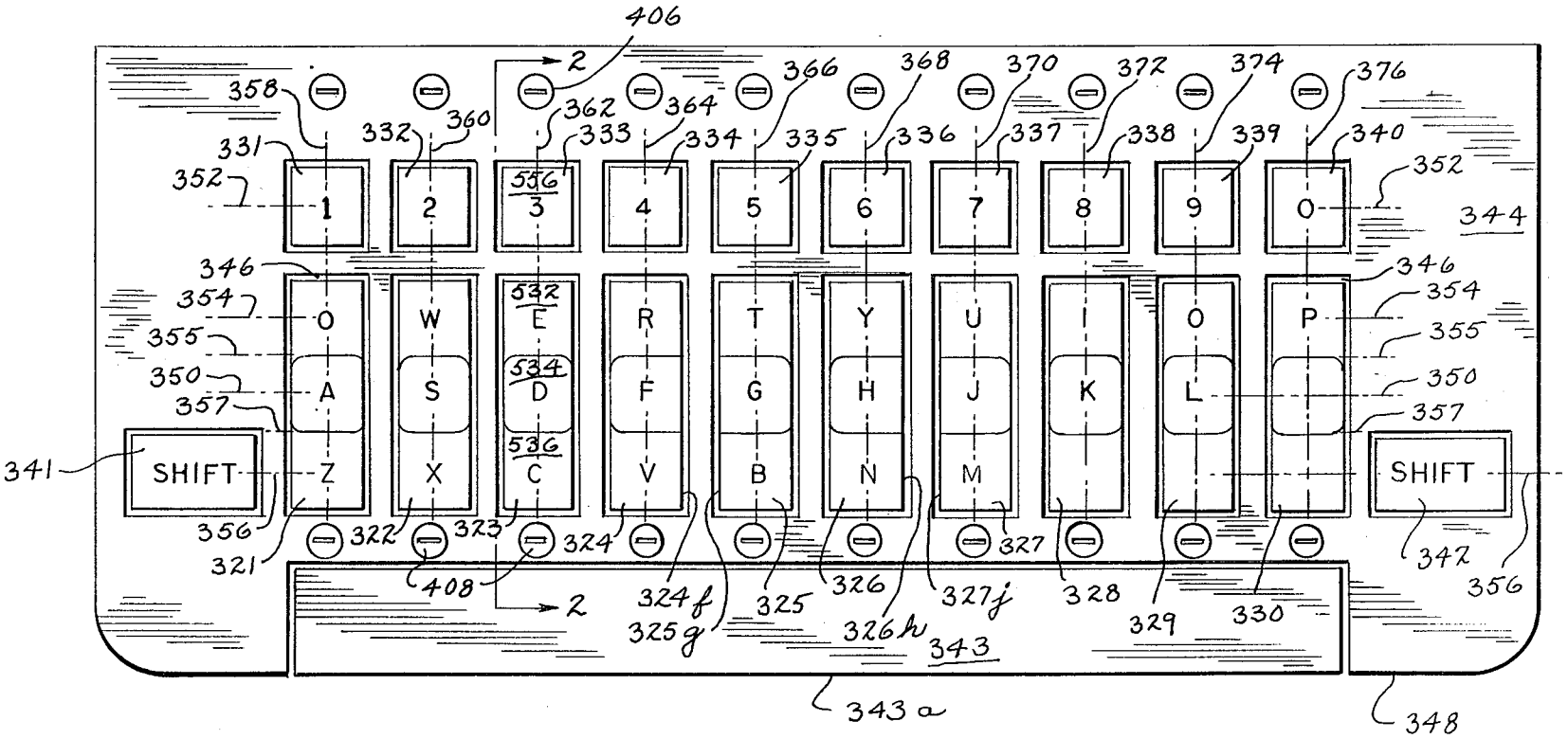
FIG. 1 is a top plan view of a keyboard embodying the principles of the invention.

Referring to FIG. 1 in particular, the keyboard illustrated therein may be seen to comprise ten elongate keys 321, 322, 323, 324, 325, 326, 327, 328, 329, and 330 and ten relatively short, additional keys 331, 332, 333, 334, 335, 336, 337, 338, 339, and 340 which are illustrated as being square. In addition, the keyboard comprises a pair of shift keys 341 and 342 and a space bar 343. The keys project upwardly through a faceplate 344, and it will be observed from FIG. 2 that the faceplate 344 inclines upwardly from the side on which the space bar 343 is located at about an angle of 10 degrees with respect to horizontal. The keys 321-340 extend upwardly beyond the upper surface of the faceplate 344 for equal distances, and upper edges of these keys lie parallel with the plate 344. The keys 321-340 each extends through an opening in the plate 344 of the same shape as the particular key, and a clearance 346 is provided between the edges of these openings and the associated key. The shift keys 341 and 342 are mechanically connected together in accordance with conventional practice so that, when one of the shift keys is depressed, the other one automatically at the same time moves downwardly through its opening in the plate 344. The space bar 343, in accordance with conventional practice, is hingedly mounted within the keyboard so that when its outer edge 343*a* (in alignment with the front edge 348 of the keyboard facing and adjacent the typist) is depressed, the space bar 343 swings downwardly and causes a spacing movement of either the carriage or the typing element in accordance with conventional practice and using conventional mechanism.

The keys 321-330 have their centers and central portions disposed on a centerline 350 which is parallel with the front edge 348 of the keyboard, and the keys 331-340 have their centers on a centerline 352 that is parallel to the centerline 350 and the keyboard edge 348. Upper portions of the elongate keys 321-330 have their centers disposed on a centerline 354, and a centerline 355 divides the upper and central portions of these keys. The lower portions of the keys 321—330 have their centers disposed on a centerline 356, and a centerline 357 divides the central and lower portions of these keys. The centerlines 354, 355, 356, and 357 are parallel with centerlines 350 and 352 and the front edge 348 of the keyboard. The keys 321—329 save the indicia A, S, D, F, G, H, J, K, and L applied to them respectively on the centerline 350, and the key 330 may have any suitable indicia (not shown) as desired applied to it on the centerline 350. The upper portions of the keys 321-330 have the indicia Q, W, E, R, T, Y, U, I, O, and P applied respectively to them on the centerline 354, and the keys 321-327 have the indicia Z, X, C, V, B, N, and M applied respectively to them on their center portions and on the centerline 356. The lower portions of the keys 328, 329 and 330 on the centerline 356 may have any suitable indicia (not shown) as desired applied to them. The keys 331-340 respectively have the indicia 1, 3, 4, 5, 6, 7, 8, 9, and 0 applied respectively to them on the centerline 352.

It will be observed that the indicia 1, Q, A, and Z and the key pair 321, 331 are in a column that has a centerline 358 extending normally or perpendicularly to all of the centerlines 350, 352, 354, 355, 356, and 357 and the front edge 348. Likewise, the following mentioned pairs of keys and the indicia thereon are disposed in columns that extend normally to the front edge 348 of the keyboard and the centerlines 350, 352, 354, 355, 356, and 357: Keys 322 and 332 on centerline 360, keys 323 and 333 on centerline 362, keys 324 and 334 on centerline 364, keys 325 and 335 on centerline 366, keys 326 and 336 on centerline 368, keys 327 and 337 on centerline 370, keys 328 and 338 on centerline 372, keys 329 and 339 on centerline 374 and keys 330 and 340 on centerline 376.

It may be noted that the keyboard as so far described and as shown in FIG. 1 hereof is nearly identical to the keyboard shown in FIG. 1 of Bleuer U.S. Pat. No. 4,449,839 above mentioned, particularly as to the elongate shapes of the elongate keys and their spacings and the placement of the letters and numerals on the centers, the upper portions and the lower portions of the elongate keys and on the various centerlines passing through the elongate keys. The keys of the present keyboard are likewise operated substantially in the same ways to produce completed electrical circuits as are the keys of the FIG. 1 keyboard in the Bleuer U.S. Pat. No. 4,449,839, as will hereafter appear.

Figure 2:
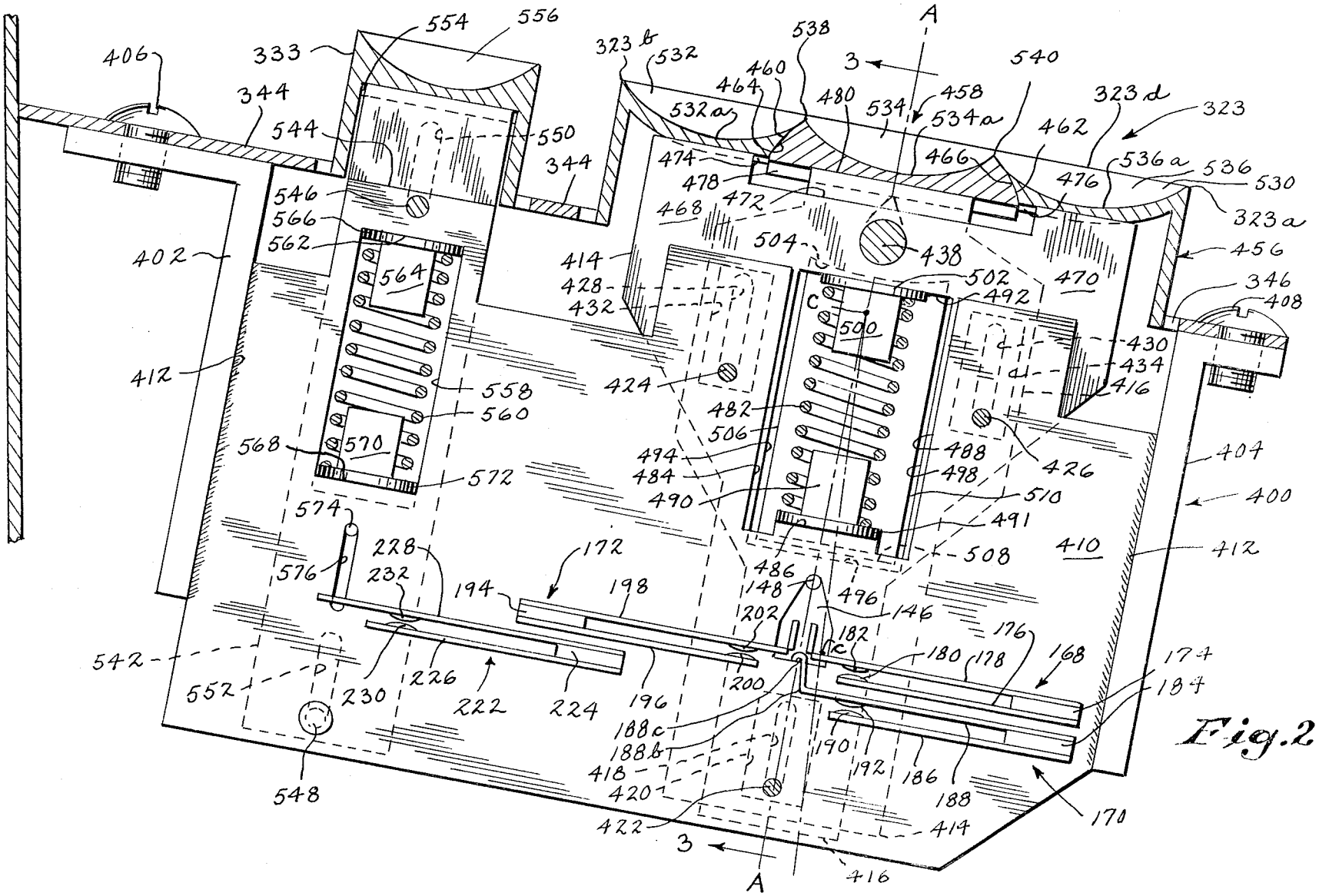
FIG. 2 is a sectional view on an enlarged scale taken on line 2—2 of FIG. 1.
Figure 3:
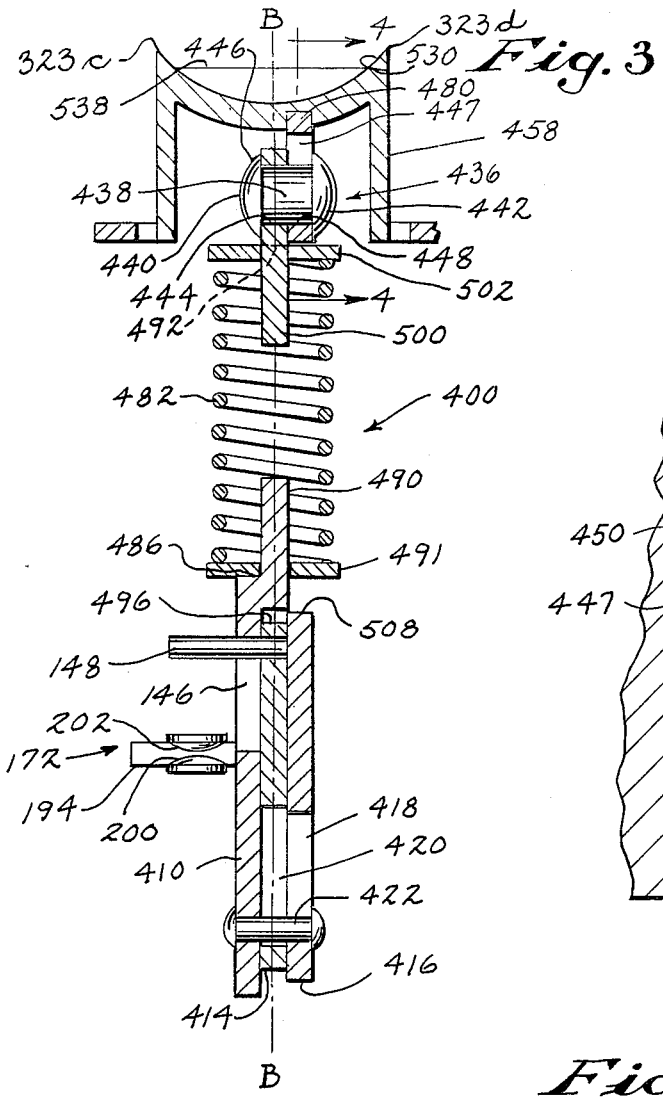
FIG. 3 is a sectional view taken on line 3—3 of FIG. 2.

The keys 323 and 333 are supported on and carried by a switch assembly 400 (see FIGS. 2 and 3 hereof), and the other pairs of keys just mentioned on the centerlines 358, 360, 364, 366, 368, 370, 372, 374, and 376 are carried by and supported by switch assemblies 400 that are identical to that shown in FIGS. 2 and 3 hereof. Since the switch assembly 400 for the various pairs of keys are identical, only the switch assembly 400 for the keys 323 and 333 and shown in FIGS. 2 and 3 hereof will be specifically described.

The switch assembly 400 as shown in FIGS. 2 and 3 comprises a pair of brackets 402 and 404 in the forms of right angles that underlie and are in constant contact with the plate 344. Machine screws 406 and 408 extend through openings in the plate 344 and are screwed into the portions of the brackets that underlie the plate 344 for holding the brackets fixed to the underside of the plate 344. A first, fixed flat plate 410 extends between and is supported by the brackets by virtue of welds 412 fixing the plate 410 to the brackets 402 and 404, with the plate 410 extending downwardly from and at right angles to the plate 344. A second, flat plate 414 (see FIG. 3), which is both swingable and also reciprocatable, is positioned in face-to-face contact with the plate 410 and is moveable on the plate 410. The plate 414 is centered on the vertical centerplane and centerline B—B of the assembly 400. A third, flat plate 416, which is purely reciprocatable, is positioned in face-to-face contact with the plate 414 and is moveable on the plate 414. The plates 416 and 414 are respectively provided with slots 418 and 420 that extend longitudinally of the plates (downwardly of the switch assembly 400, on centerline A-A as the parts appear in FIG. 2). The slot 420 is considerably wider than the slot 418 as is shown in FIG. 2 hereof. A headed rivet 422 extends through the plate 410 and through the slots 418 and 420 and is sufficiently long between its heads so that the plate 414 can reciprocate with respect to the plate 41O and so that the plate 416 can reciprocate with respect to the plate 414. The rivet 422 is tightly disposed in the opening in the plate 410 through which the rivet 422 extends and, being headed, holds the plates 410, 414 and 416 together as is apparent.

Headed rivets 424 and 426, which are similar in construction and disposition to the rivet 422, hold the plates 410, 414 and 416 together close to their upper ends and allow the same reciprocation of the plates as has just been mentioned in connection with the rivet 422. Spaced longitudinally extending slots 428 and 430 are provided in the plate 416 through which the rivets 424 and 426 respectively extend, and wider longitudinally extending slots 432 and 434 are provided in the plate 414 through which the rivets 424 and 426 respectively extend.

Figure 4:
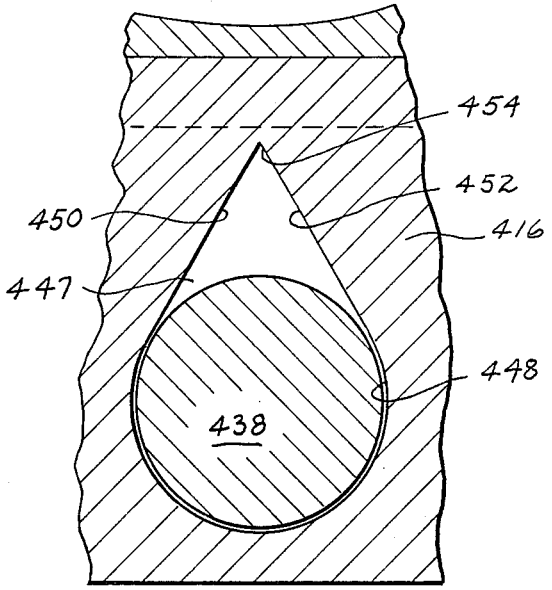
FIG. 4 is a sectional view on a still further enlarged scale taken on line 4—4 of FIG. 3.
Figure 7:
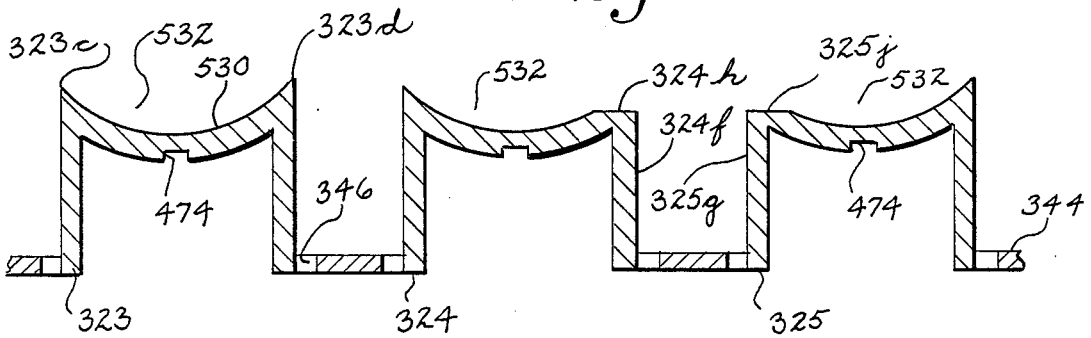
FIG. 7 is a sectional view taken on line 7—7 of FIG. 6.
Figure 8:
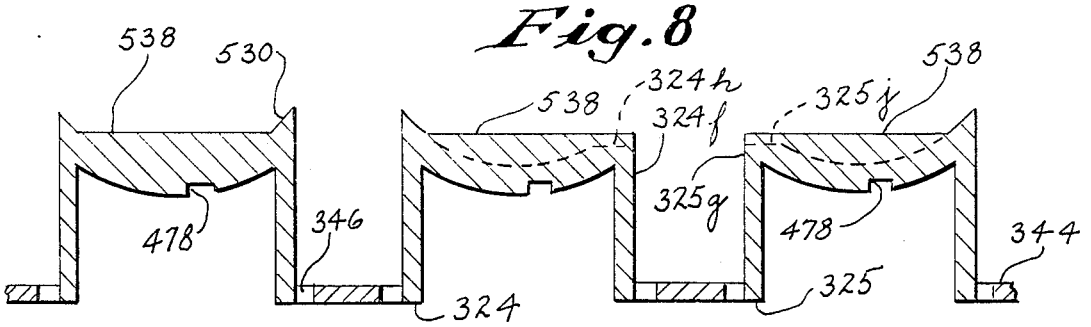
FIG. 8 is a sectional view taken on line 8—8 of FIG. 6.

A rivet 436 (see FIG. 3) extends through the upper ends of the plates 414 and 416. The rivet comprises a cylindrical shaft 438, which is considerably larger in diameter than the shafts of the rivets 422, 424 and 426, and has heads 440 and 442 on the opposite ends. The rivet 436 extends through and is tightly disposed in an opening 444 in the plate 414, and the head 440 is welded at 446 to the plate 414. The rivet 436 extends through an opening 447 in the plate 416 which has a cylindrical portion 448 and an upwardly extending notch formed by flat edges 450 and 452 diverging outwardly and downwardly from an apex 454 (see FIG. 4). The cylindrical portion 448 of the opening 447 is slightly larger in diameter than the shaft 438 as is shown in FIG. 4 so that the shaft 438 fits loosely in the opening 447. The head 442 is also rather loose with respect to the plate 416 so that the plate 416 can move slightly with respect to the rivet 436 as will be hereinafter described.

The elongate key 323 is formed by two parts, namely, the long auxiliary key 456 and the short auxiliary key 458. The long auxiliary key 456 is articulated or swingable with respect to the short auxiliary key 458 on the rivet 436 which constitutes a pivot, connection and is located just below the key 458. For facilitating the swinging action, the short auxiliary key 458 has cylindrical bearing surfaces 460. and 462. Cylindrical bearing surfaces 464 and 466 are provided on the long auxiliary key 456, and these surfaces 464 and 466 respectively touch and mate with the surfaces 460 and 462. All of the surfaces 460, 462, 464, and 466 have their centers on the longitudinal axis of the rivet shaft 438.

The plate 414 had two upwardly extending tongues 468 and 470 on its upper end which are spaced by a bridging portion 472. The long auxiliary key 456 is provided with slots 474 and 476 on its lower surface, and the tongues 468 and 470 respectively fit into and are cemented into the slots 474 and 476 so as to fix the plate 414 with respect to the long auxiliary key 456. The short auxiliary key 458 is provided with a slot 478 on its under surface, and the plate 416 is provided with a tongue 480 on its upper end that extends into and is cemented in the slot 478 so as to fix the plate 416 with respect to the short auxiliary key 458.

A coiled spring 482 is provided for yieldably forcing the auxiliary keys 456 and 458 upwardly, and three substantially registered windows are provided in the plates 410, 414 and 416 for receiving the spring 482. The window in the plate 410 is open ended at the top and is formed by edges 484, 486 and 488. The plate 410 at the bottom of its window is formed with a tongue 490 which extends into the window and is bent also to extend into the plane of the plate 414 as is shown in FIG. 3. The spring 482 extends about and is guided by the tongue 490 as is shown in this figure, and a washer 491 is disposed between the bottom of the spring and the edge 486 which may. be considered as an abutment edge.

The spring window in the plate 414 is formed by a top edge 492, a side edge 494, a bottom edge 496 and another side edge 498. The plate 414 is provided with a tongue 500 at its top edge 492 which may be considered as another abutment edge, and a washer 502 is disposed about the tongue 500. The tongue 500 guides the spring 482, and the washer 502 supports the top end of the spring 482.

The spring window in the plate 416 is formed by the top edge 504, the side edge 506, the bottom edge 508 and the other side edge 510. It will be noted that the top and the bottom edges 504 and 508 are spaced from the washers 502 and 491 so that there is no interference between these edges and the washers. It will be noted also that all three of these windows in the plates 410, 414, and 416 receive the spring 482 which has a greater diameter than the widths of these windows and that the longitudinal centers of these windows and of the spring 482 are disposed on the vertical center lines A—A and B—B.

The plate 414 in its movements to be described actuates electrical switch mechanism which is substantially the same as the electrical switch mechanism disclosed in the prior Bleuer U.S. Pat. No. 4,449,839 above referred to. The fixed plate 410 is provided with an elongate opening 146 therethrough (see FIGS. 2, 3 and 5), and a cylindrical pin 148 carried by and fixed in plate 414 extends through the opening 146. As is clear from FIG. 3, the pin 148 extends completely through the opening 146 and beyond the plate 410.

Figure 5:
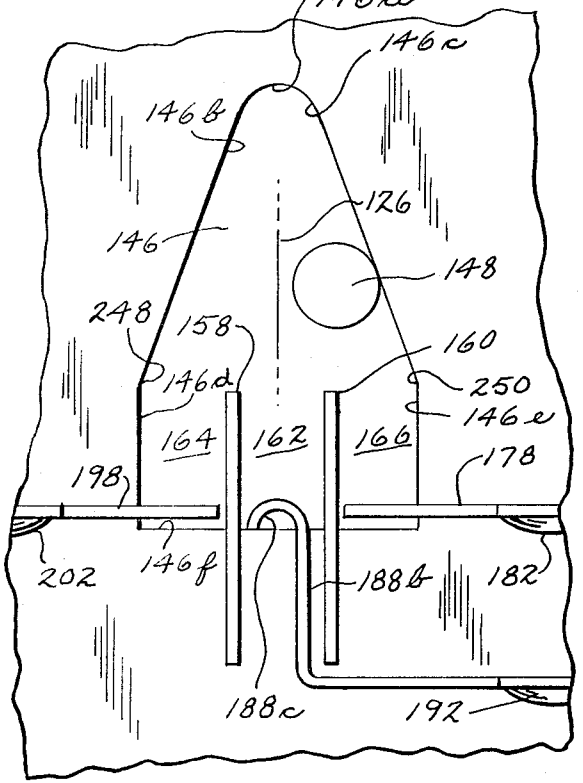
FIG. 5 is a side elevational view on an enlarged scale of portions of the switches and of the actuator pin constituting parts of the elongate key actuated switching mechanism and showing the actuator pin in a position which is changed from its position shown in FIGS. 2 and 3.

The opening 146 (see FIG. 5) has a curved upper edge **146*a*, two downwardly flaring diverging edges 146*b* and 146*c* connected with the curved edge 146*a*, two opposite parallel edges 146*d* and 146*e* connected with the edges 146*b* and 146*c* and a bottom edge 146*f* that is perpendicular to the edges 146*d* and 146*e* and connects these two edges. The edges 146*b* and 146*d* and the edges 146*c* and 146*e* have sharp corners 248 and 250 between them for providing tactile effects as will be described. The pin 148 is shown in FIG. 5 in an intermediate position, while the pin 148 is shown in FIGS. 2 and 3 in its uppermost position in engagement with the curved edge 146*a*. The curved edge 146*a* and the pin 148 have the same radius so that the pin 148 fits snugly in contact with the edge 146*a*. A pair of leaf springs 158** and 160 have their lower ends embedded in the plate 410 and extend upwardly from the edge 146*f* in parallel relationship to the edges 146*d* and 146*e*. The springs 158 and 160 between them may be said to define a middle slot 162; the spring 158 and the adjacent edge 146*d* may be said to define a side slot 164; and the spring 160 and adjacent edge 146*e* may be said to define another side slot 166.

The pin 148 in moving downwardly through the opening 146 and through the slots 162, 164 and 166 actuates three electric switches 168, 170 and 172 (see FIG. 2). The switch 168 comprises a slab 174 of insulating material and leaf springs 176 and 178. The insulator slab 174 is fixed on one edge onto the plate 410, and the leaf springs 176 and 178 are fixed on the slab 174 and out of contact with the plate 410. The springs 176 and 178 are of electrically conducting material and respectively carry electric contacts 180 and 182. The spring 178 is longer than the spring 176 and has a portion that extends into alignment with the slot 166. The switch 170 is of similar construction and actuated by said includes an insulator slab 184, leaf springs 186 and 188 and two contacts 190 and 192 carried respectively by the springs 186 and 188. The spring 188 terminates in an upwardly extending portion 188*b* having a rounded end portion 188*c* in alignment with the slot 162. The switch 172 is practically identical with the switch 168 and includes a slab 194 of insulating material fixed to the plate 410, a pair of leaf springs 196 and 198 and a pair of contacts 200 and 202. The leaf spring 198 underlies the slot 164.

The upper surface of the key 323 is similar to the upper surfaces of the elongate keys shown in FIG. 1 of said Bleuer U.S. Pat. No. 4,449,839 in being provided with a trough 530 (see FIGS. 2, 3, 7 and 8) that extends between the two side edges 323*c* and 323*d* of the key 323. All of the key edges 323*a*–323*d* are at the top of the key 323 as is apparent and are co-planar. The upper surface of the key 323 is also provided with recesses or indentations 532, 534 and 536; and the bottom surfaces 532*a*, 534*a* and 536*a* of these indentations also form the bottom surface of the trough 530. The bottom surfaces 532*a*, 534*a* and 536*a* of the indentations 532, 534 and 536 are approximately arcs of spheres as is apparent from an inspection of FIG. 3 and form finger tablet surfaces as will hereinafter appear. Upraised ridges 538 and 540 divide the indentations 532, 534 and 536 from each other; and these ridges are formed by and are at the upper portions of the junctures of the cylindrical surfaces 460, 462, 464 and 466 that lie on the centerlines 355 and 357. The end portions of these junctures exclusive of the ridges 538 and 540 extend toward the centerline 350 as shown in FIG. 1. As is apparent from FIGS. 2 and 3, the ridge 538 is below the side edges 323*c* and 323*d*; and the same is true of the ridge 540. The bottom surface 532*a* of the indentation 532 extends from the upper edge 323*b* of the key 323 to the ridge 538; the bottom surface of the indentation 534 extends between the ridges 538 and 540 which are respectively on the centerlines 355 and 357; and the bottom surface of the indentation 536 extends from the ridge 540 to the lower edge 323*a* of the key 323. The edges 323*b* and 323*a* form closed ends of the trough 530, with the bottom surfaces 532*a* and 536*a* extending upwardly faster toward the key edges 323*b* and 323*a* than toward the ridges 538 and 540, since the ridges 538 and 540 are below the key side edges 323*c* and 323*d* (see FIG. 2).

The key 333 is reciprocatably mounted to move downwardly through an opening in the plate 344 by means of a plate 542 that is slidably disposed on the plate 410 (see FIG. 2). The plate 410 has an upraised portion 544; and a rivet 546, similar to the rivets 422, 424 and 426, extends through the plates 410 and 542. Another such rivet 548 extends through lower portions of the plates 410 and 542. Slots 550 and 552 are respectively provided in the plate 542 for receiving the two rivets 546 and 548 so that the plate 542 may reciprocate upwardly and downwardly. The bottom surface of the key 333 is provided with a slot 554, and the upper edge of the plate 542 is cemented in the slot 554 for fixing the key 333 with respect to the plate 542. The key 333 is provided with an indentation or recess 556 in its upper surface, and the bottom of the indentation 556 functions as a finger tablet surface for receiving a human finger for depression of the key 333.

The plates 410 and 542 are provided with windows 558 that are in register when the plate 542 is at the upper limit of its movement as it is shown in FIG. 2, and a compression spring 560 is disposed in the windows 558. The window 558 in the plate 542 is defined in part by a downwardly facing edge 562 having a tongue 564 extending downwardly from it, and a washer 566 fits about the tongue 564 and rests on the edge 562. The window 558 in the plate 410 is defined at its bottom by an edge 568, and a tongue 570 extends upwardly from the edge 568. The plate 410 is bent at its edge 568 similarly as at the edge 486 so that the tongue 570 is in the plane of the plate 542. A washer 572 is disposed about the tongue 570 and rests on the edge 568. The spring 560 is disposed between the washers 56 and 572, and the force of the spring 560 is thus taken by the edges 562 and 568.

A pin 574 is fixed in the plate 542 and extends through a vertical slot 576 provided in the plate 410. The pin 574 actuates a switch 222 which is similar to the switch 168 and comprises a pad 224 of insulating material fixed to the plate 410, a pair of electrically conductive leaf springs 226 and 228 fixed to the pad 224 and a pair of contacts 230 and 232 carried by the leaf springs 226 and 228. The leaf spring 228 has an end portion underlying the slot 576 so that the leaf spring 228 is depressed by the pin 574 as it travels downwardly in the slot 576.

Figure 6:
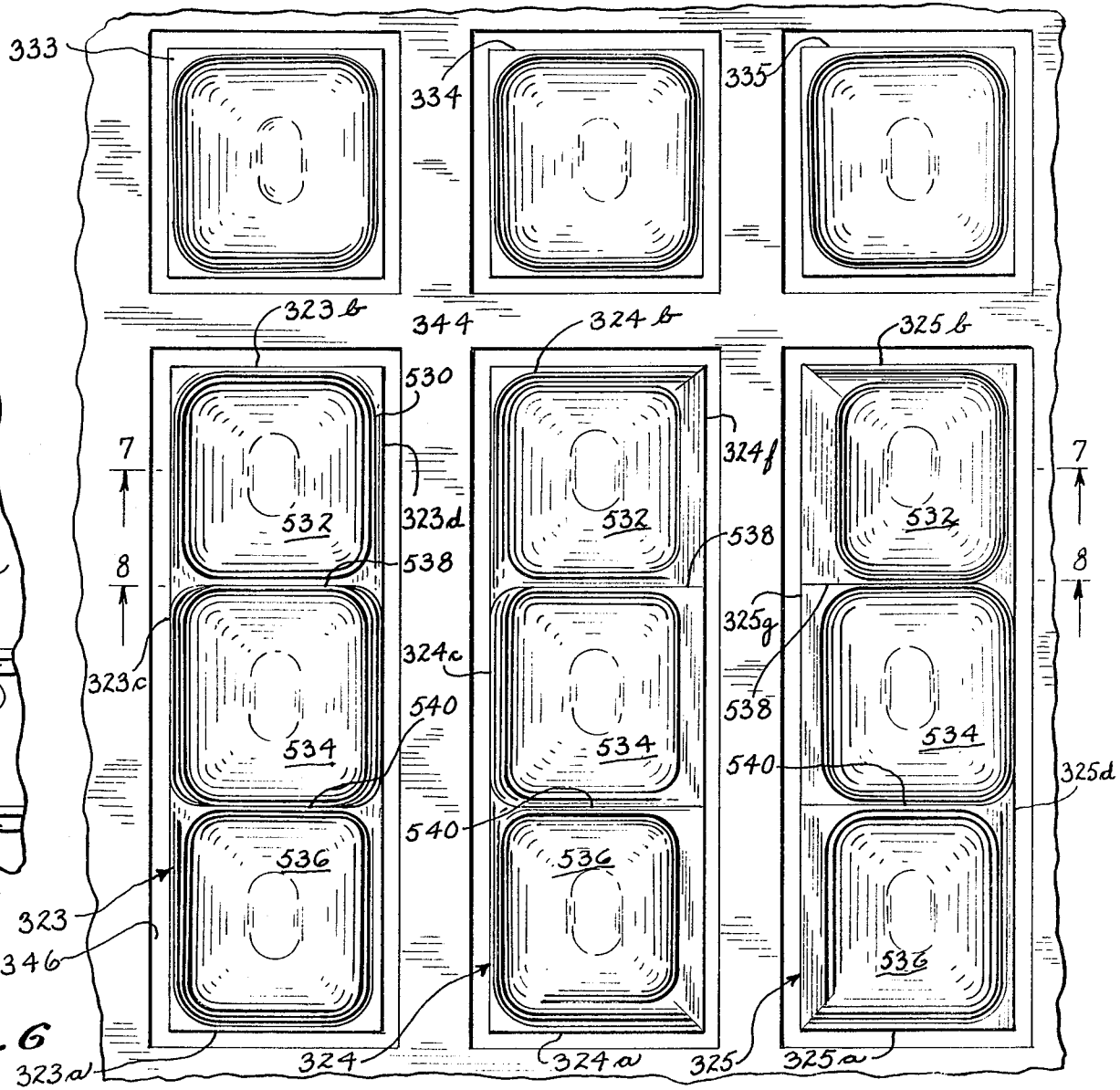
FIG. 6 is a top plan view on an enlarged scale of three of the elongate keys of the keyboard shown in FIG. 1 together with the associated relatively short keys spaced from the elongate keys.

The keys 321, 322 and 324–330 and the switch actuating mechanisms of these keys are the same as the key 323 and its switch actuating mechanism as described except that the upper surfaces of the keys 324–327 have been modified by reducing the height of adjacent edges of the keys 324 and 325 and the adjacent edges of the keys 326 and 327 so as to facilitate the sideward reaching by the index fingers in depressing the keys 325 and 326 in lieu of the keys 324 and 327. The other edges of the keys 321–330 are the same in heights; for example, the key edges 324*a*–324*c* and the key edges 325*a*, 325*b* and 325*d* are at the same height as the key edges 323*a*–323*d* (see FIG. 6).

The adjacent reduced height edges of the keys 324 and 325 are the adjacent edges 324*f* and 325*g* (see FIGS. 1, 6, 7 and 8). These edges respectively correspond to the edges 323*d* and 323*c* of the key 323, and the edges 324*f* and 325*g* on the centerline 355 are reduced to the height of the ridges 538 and 340 (see FIG. 8 in particular) It will be observed from FIG. 8 that the ridges 538 of the two keys 324 and 325 on the edges 324*f* and 325*g* are in line at the same height. The edges 324*f* and 325*g* on the section line 7—7 and on the centerli still farther to have the surfaces 324*h* and 325*j* which are still, however, above the lowermost portions of the rcesses 532 in the keys 324 and 325. The same reductions in height of the keys 324 and 325 are made on the centerlines 350, 357 and 356 so that the edges 324*f* and 325*g* from the side have a scalloped outline provided by the relatively high and equally high ridges 538 and 540 and the relatively low surfaces between these ridges of the height of the surfaces 324*h* and 325*j*. The heights of the adjacent edges 326*h* and 327*j* (see FIG. 1) are reduced in the same manner to have the same scalloped outline as the reduced height edges 324*f* and 325*g* so that the ridges 538 and 540 on the edges 326*h* and 327*j* are in line and unbounded on the adjacent edges and so that the recesses 532, 534 and 536 are reduced in height to the height of the surfaces 324*h* and 325*j* on the adjacent edges 326*h* and 327*j*.

In operation, the elongate key 323 and the switch assembly 400 operate to close the switches 168, 170 and 172 depending on the portion of the key 323 that is depressed (see FIGS. 2 and 3 in particular). In all cases, the key 323 moves downwardly essentially on its thrust axis (the vertical center line A—A) which is normal to the upper surface of the key 323 as it is shown in FIG. 2. When a finger of the operator is used to depress the short auxiliary key 458 on the thrust axis of the key 323 (center line A—A) using the finger in the recess 534 on the tablet surface 534*a*, the key 323 moves downwardly with no relative swinging movement between the auxiliary keys 456 and 458, moving the pin 148 straight downwardly (on centerline A—A) along with simultaneous downward movement of both plates 414 and 416, so that the pin 148 passes between leaf springs 158 and 160 in the middle slot 162 whereby pin 148 abuts against the spring portion 188*c* and moves the spring 188 downwardly so as to move the contact 192 into contact with the contact 190 and close the switch 170. Switch closing force is transmitted by the upper portion of the plate 416 to the shaft portion 438 of the rivet 436 and from thence to the plate 414 which carries the pin 148. Since the rivet 436 connects the plates 414 and 416, they move downwardly (on center line A—A) together at this time. The spring 482 is effective between the edge 492 on the plate 414 and the edge 486 on the fixed plate 410, and this movement of the plate 414 and the pin 148 is thus against the restraining action of the spring 482. For this action, finger pressure is applied onto the auxiliary key 458 and thus on the plate 416, and this pressure wedges the diverging flat edge 450 and 452 onto the shaft portion 438 of the rivet 436 so as to prevent any swinging movement of the auxiliary key 456, since the rivet 436 and thus the the auxiliary key 456 are thus locked to the plate 416 which is held to strict reciprocation by means of the rivets 424, 426 and 422. The plate 416 can have only reciprocation and no swinging motion due to the fact that the plate 416 has the relatively narrow slots 428, 430 and 418 which are moveable with respect to the fixed rivets 424, 426 and 422. The plate 414 and thus the pin 148 carried by the plate 414 are thus held to straight downward movement along with the auxiliary key 456 (along centerline A—A) assuring that the switch 170 under these conditions, rather than the switches 168 and 172, is closed. In the wedging action by the edges 450 and 452, it will be noted that the finger pressure is applied downwardly from the auxiliary key 458, while the rivet 436, being fixed with respect to the plate 414, is restrained by the spring 482 effective on the plate 414, so the engaging action by the edges 450 and 452 is due basically to finger pressure n the central auxiliary key 458 acting against the restraining force of the spring 482.

If finger pressure is instead applied in one of the recesses 532 or 536 in lieu of the recess 534, the key 323 descends in much the same manner, but in this case the auxiliary key 456 swings slightly with respect to the central key 458. The cylindrical surfaces 466 and 464 slide on the mating cylindrical surfaces 460 and 462, and the swinging movement of the auxiliary key 456 is about the shaft portion 438 of the rivet 436. If it is assumed that the finger pressure is applied in the recess 532, the pin 148 rides on the edge 146*c* which limits the counterclockwise swinging movement of the auxiliary key 456 and plate 414 (as seen in FIG. 2) and moves downwardly into the side slot 166. This is by virtue of the fact that the pin 148 is fixed within the plate 414 which in turn has the auxiliary key 456 fixed to it, and the depression of the key 323 with the swinging movement of auxiliary key 456 is against the action of the spring 482 which acts between the edge 492 on the plate 414 and the edge 486 on the fixed plate 410. There is no wedging action of the edges 452 and 450 with respect to the portion 438 of the rivet 436 under these conditions, since there is no downward pressure exerted on the central auxiliary key 458 at this time; but the rivet 436 connecting the plates 414 and 416 assures that the plates move downwardly together. As the plate 414 and pin 148 complete their downward movements with accompanying swinging of the auxiliary key 456, the pin 148 moves through the slot 166 and contacts the leaf spring 178. The leaf spring 178 is thus bent to bring the contacts 182 and 180 together so as to close the switch 168. The relatively sharp corner 250 between the edges 146*c* and 146*e* provides a tactile effect with respect to the key 323, indicating to the user that the pin 148 has moved into a side slot instead of the middle slot 162.

From a consideration of FIG. 2, it will be apparent that the swing of the auxiliary key 456 is quite slight so that it is hardly perceptible. The centers of the rivet 436 and the pin 148 when the switch 168 is thus closed are respectively at C and c (see FIG. 2), and the center line c—C very apparently in this figure is at a very small angle with respect to the center line A—A on which the centers of the rivet 436 and pin 148 were originally disposed. With the parts having the relative dimensions as shown in FIG. 2, the angle between the center line A—A and the center line c—C is about 3 degrees. Thus, in this case also, the key 323 has moved essentially downwardly on its thrust axis (centerline A—A).

If finger pressure is instead applied in the recess 536 in lieu of the recess 532, the action of the key 323 in closing the switch 172 is substantially the same as just described in connection with the switch 168 except that the auxiliary key 456 is swung in the opposite direction. In this case, the pin 148 rides on the slanted edge 146*b* thus limiting the clockwise swinging movement of the auxiliary key 456 about the rivet 436, and the pin 148 as it completes its downward and sideward movement enters the slot 164 into engagement with the leaf spring 198 of the switch 172. The contact 202 is thus brought into engagement with the contact 200 closing the switch 172. In this case, the relatively sharp corner 248 provides a tactile indication to the user that the key 323 has completed one of the side switches 172 and 168.

When the key 323 is released after depression, the spring 482 pressing against the edge 492 of the swingable plate 414 moves the plates 414 and 416 upwardly back into their original positions in which they are shown in FIGS. 2 and 3. If the long auxiliary key 456 has been used for making either the switch 172 or the switch 168, the pin 148 travels along either the edge **146*b* or the edge 146*c*, and the pin 148 in thus moving brings the swingable auxiliary key 456** back into its unswung position as it is shown in FIG. 2.

As is indicated in FIG. 1, the key 323 has the letter "D" imprinted in the recess 534, the letter "E" imprinted in the recess 532 and the letter "C" imprinted in the recess 536. With this arrangement of letters, the switch 170 may thus be connected with an associated typewriter, terminal or computer to cause the letter "D" to be printed, typed or stored when the switch 170 is made; and likewise the switches 168 and 172 may be connected in the same manner with respect to the letters "E" and "C". Similarly, the switch assemblies 400 for the other keys 321, 322 and 324—330 may be connected with an associated typewriter, printer or computer for storing or printing the particular letters indicated on these particular keys in FIG. 1, and the switch assemblies 400 for these other keys operate in the same way as has just been described for the key 323. It is apparent also that any other arrangement of letters (such as the well known Dvorak arrangement of letters) may be used in connection with the keys and the associated computer, typewriter or printer.

The numeral key 333 is depressed in order to close the switch 222, and this has the function of moving the pin 574 to engage the leaf spring 228 of the switch 222 so as to bring the contact 232 into engagement with the contact 230. As previously described, the pin 574 is fixed on the plate 542 on which the key. 333 is affixed, and the plate 542 and pin 574 are moved downwardly against the action of the spring 560. The key 333 may be connected in the same manner as the elongate keys with associated printer, computer, etc. mechanism for printing or storing the numeral "3" imprinted on the key 333. The other numeral keys, 331, 332 and 334—340, are actuated in the same manner and connected in the same manner as is the key 333.

The purpose of the trough 530 extending longitudinally of the key 323 is to guide the middle finger of the left hand into the recesses 532, 534 and 536. The other elongate keys 321, 322, and 324–330 also have the same troughs, and these likewise guide the appropriate fingers longitudinally of the keys into the recesses 532, 534 or 536 of the key. It is contemplated that the keyboard shall be used for ordinar.y touch typing with the four fingers of the left hand being on the imprinted letters "A", "S", "D" and "F" and with the four fingers of the right hand being on the imprinted letters actuated by said "J", "K", "L" and _, these letters making up the "home" row. For this touch typing, it is only necessary that the user move his four fingers of each hand toward or away from himself prior to depressing the tablet surfaces **532*a*, 534*a* and 536*a*, for example. The index fingers in this touch typing are responsible not only for depressing the keys 324 and 327, but they must also reach sidewardly to depress the keys 325 and 326. The reduced height edges 324*f* and 325*g* of the adjacent keys 324 and 325 make it easy for a person to shift his index finger of the left hand from the key 324, which is the home key for this finger, to the key 325 for which a reaching action is necessary. Likewise, the reduced height edges 326*h* and 327*j* of the keys 326 and 327 facilitate the movement of the index finger of the right hand from the home key 327 to the adjacent key 326. Since the numeral keys 331–340 are respectively in alignment with the ten elongate keys 321–330**, it is only necessary for the operator to move his fingers slightly farther away from himself prior to depressing any of the numeral keys.

The shift keys 341 and 342 may be connected as conventionally with the associated typewriter, printer or terminal mechanism in order to utilize upper case letters in lieu of lower case letters, and likewise the space bar 343 is connected as conventionally with such mechanism.

Figure 10:
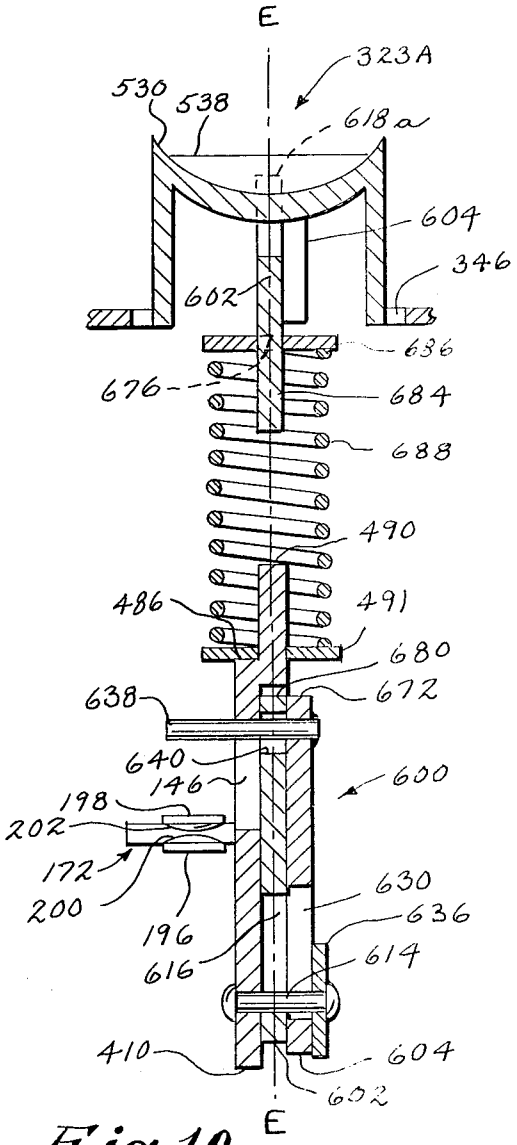
FIG. 10 is a sectional view taken on line 10—10 of FIG. 9.
Figure 9:
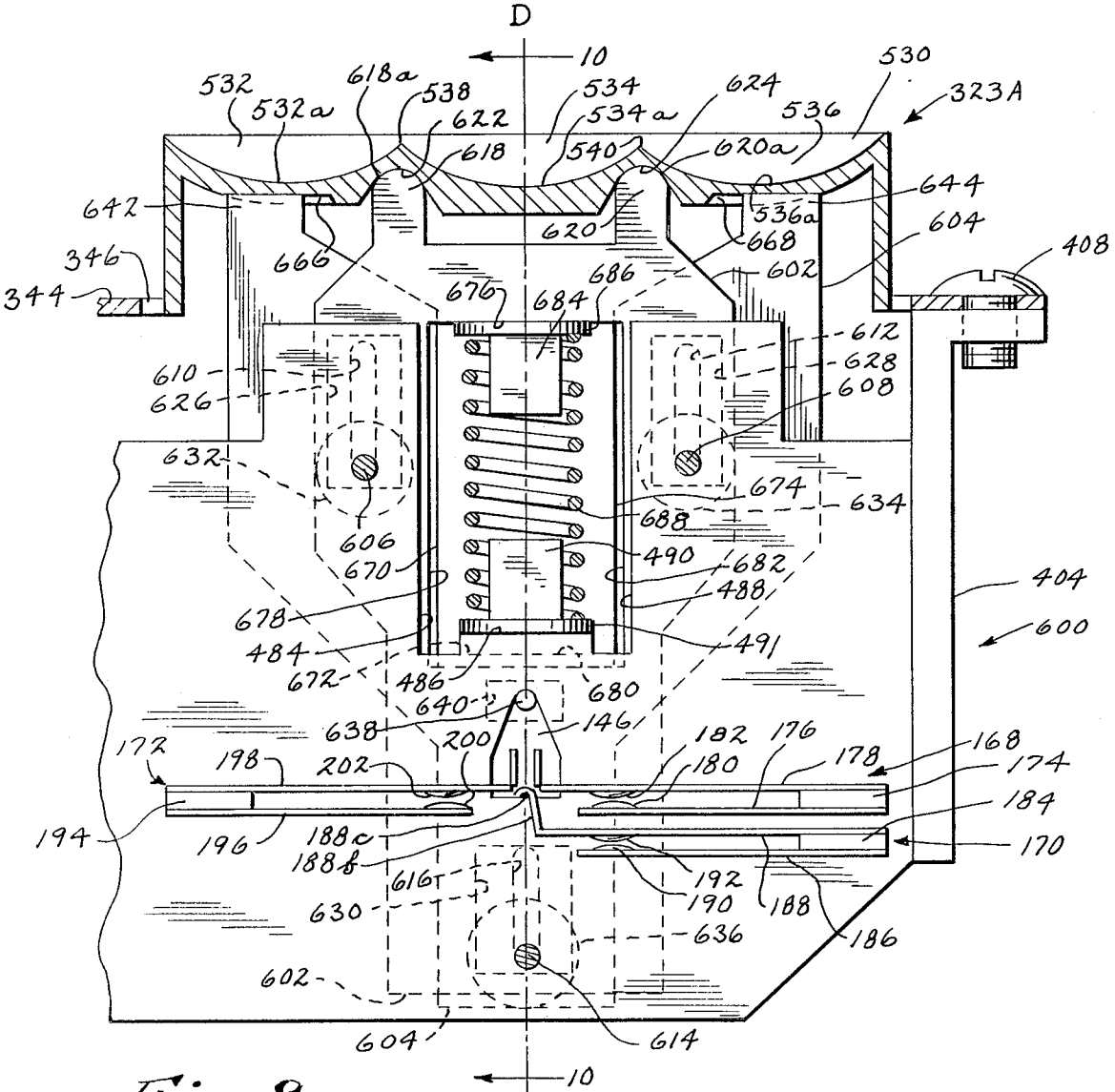
FIG. 9 is a sectional view similar to FIG. 2 and showing a modified elongate key and key operated electrical switching mechanism.

The switch mechanism 600 (see FIGS. 9 and 10) and the associated elongate key 323A may be substituted for the switch mechanism 400 and the elongate key 323. Likewise the other elongate keys 321, 322 and 324–330 and their switch mechanisms 400 may be replaced by a switch mechanism 600 and an elongate key identical with elongate key 323A. The switch mechanisms 400 and 600 are similar in that they each have a row or series of three control plates in sliding contact with each other, and each of the switch mechanisms 400 and 600 utilizes the first stationary mounting plate 410. In addition, as has been described, the switch mechanism 400 has the moveable plates 414 and 416 in the row while in lieu thereof the switch mechanism 600 has the moveable plates 602 and 604 in the respective row. The key 323A has the same top surface contours as the key 323 and in particular has the longitudinal trough 530, the raised ridges 538 and 540 and the three finger receiving indentations 532, 534 and 536; but the keys 323 and 323A differ in that the key 323A is integral end-to-end instead of articulated. The plate 410 and the switch mechanism 600 of FIGS. 9 and 10 is fastened to the plate 344 in the same manner as in the switch mechanism 400 of FIG. 2 and has the opening 146 with the switches 168, 170 and 172 mounted in close proximity to the opening 146 as in the FIG. 2 construction. The plate 410 in FIGS. 9 and 10 also has the tongue 490 which is bent into the central plane of the switch mechanism (on center line E—E) as is shown in FIG. 10 and to have the edge 486 and has the same spring receiving window defined by the edges 484, 486 and 488.

The plate 602 is in the central plane (on the center line E—E) of the switch mechanism 600 as shown in FIG. 10 and reciprocatively mounts the key 323A with accompanying reciprocation of the plate 602. The plate 602 is reciprocatively mounted for pure reciprocation with respect to the plate 410 by means of headed rivets 606 and 608 (corresponding to the rivets 424 and 426 in the switch mechanism 400) that extend through narrow slots 610 and 612 formed in the plate 602 ad by means of a headed rivet 614 (corresponding to the rivet 422 in the switch mechanism 400) that extends through a narrow slot 616 formed in the plate 602. The plate 602 is formed with a pair of upstanding tongues 618 and 620 that have rounded upper edges **618*a* and 62O*a*, and these rounded edges respectively fit in rounded cavities 622 and 624 formed in the under surface of the key 323A so that the key 323A may swing in either one direction or the other about the rounded edges 618*a* and 62O*a* as will be more fully described hereinafter. The rounded cavities 622 and 624 and the rounded edges 618*a* and 62O*a* are in vertical alignment (parallel with center line D—D) with the raised ridges 538 and 540 in FIG. 9** as is apparent from this figure.

The plate 604 is held in contact with the plate 602 by means of the rivets 606, 608 and 614 which extend through the slots 626, 628 and 630 respectively in the plate 604. The slots 626, 628 and 630 are relatively wide in comparison with the slots 610, 612 and 616 to allow the plate 604 to swing along with reciprocation; and relatively large diameter washers 632, 634 and 636 are provided on the rivets 606, 608 and 614 and bridging the slots 626, 628 and 630 to assure that these rivets hold the plate 604 in contact with the plate 602 as the plate 604 swings and reciprocates as will be hereinafter more fully described.

A pin 638 similar to but longer than the pin 148 of the first embodiment is fixed in the plate 604 and extends through a slot 640 in the plate 602 and into the opening 146 to be effective on the switches 168, 170 and 172 as will be hereinafter explained.

The plate 604 has two upstanding tongues 642 and 644, and these tongues are cemented in slots 666 and 668 formed in the bottom surface of the key 323A so as to fix the plate 604 with respect to the key 323A. The plate 604, between its tongues 642 and 644, is provided with a window which is open at its top and which is defined by edges 670, 672 and 674.

The plate 602 is provided with a window which is bounded by the edges 676, 678, 680 and 682, and a downwardly extending tongue 684 is formed on the edge 676. A washer 686 is provided on the tongue 684, and a coiled spring 688 fits on the tongue 684 and rests on the washer 686 at the top end of the coiled spring 688. The bottom end of the spring 688 is disposed over the tongue 490 formed on the plate 410 and rests on the washer 491 that in turn rests on the edge 486 of the plate 410. The edges 676 and 486 are thus abutment edges with respect to the spring 688. The spring 688 is disposed in the windows of the three plates which have just been described and has its longitudinal center on both of the center lines D—D and E—E.

In operation, the assembly 600 functions, similarly to the assembly 400, to selectively close the switches 168, 170 and 172 depending on the particular recess 532, 534 and 536 of the elongate key 323A in which finger pressure is applied. If finger pressure is applied on the tablet surface **534*a* bottoming the recess 534, the elongate key 323A moves directly downwardly on the key thrust axis (centerline D—D) along with such translatory movement of the reciprocatable plate 602 and the plate 604 which both reciprocates and swings. Since finger pressure is applied between the rounded edges 618*a* and 62O*a*, there is no tendency for the elongate key 323*a* to swing about either of these rounded edges. The pin 638 is fixed on the swingable plate 604, and since this plate and the key 323A are fixed with respect to each other, the pin 638 moves directly downwardly in the opening 146 (see FIG. 5) into the middle slot 162. The pin 638 under these conditions functions the same as the pin 148 to close the switch 170. This downward movement of the key 323A and of the reciprocatable plate 602 is against the action of the spring 688 effectively between the edge 486 on the fixed plate 410 and the edge 676 on the reciprocatable plate 602, and the spring 688 moves the plate 602 and key 323A back into their original positions when finger pressure is released from the tablet surface 534*a* of the key 323A**.

If finger pressure is instead applied in the recess 532 on the tablet surface **532*a*, there is a torque thus applied onto the key 323A tending to swing the key 323A in the counterclockwise direction as seen in FIG. 9 about the rounded edge 618*a*. The key 323A moves the reciprocatable plate 602 downwardly, and the swingable plate 604 moves along so that the pin 638, functioning like the pin 148, rides along the edge 146*c* until the pin 638 moves into the side slot 166 and contacts the leaf spring 178 of the switch 178 to thus close the switch 168. This movement again is against the action of the spring 688, and the spring 688 together with the pin 638 riding back along the edge 146*c* return the key 323A and plates 602 and 604 back into their original positions in which they are shown in FIG. 9**.

If finger pressure is instead applied on the tablet surface **536*a* in the recess 536, the key 323A swings in the opposite direction, in the clockwise direction, so that as finger pressure moves the reciprocatable plate 602 downwardly against the action of the spring 688, the swingable plate 604 together with the pin 688 move downwardly, with the pin 638 traveling along the edge 146*b*. Finally this movement is sufficient so that the pin 638 engages with the leaf spring 198 of the switch 172 so as to bring the contacts 202 and 200 into engagement to close the switch 172. The spring 688 and pin 638 function as before to return the key 323A and the plates 602 and 604 back into their original positions in which they are shown in FIGS. 9 and 10 when finger pressure is released on the key. 323A**.

The switch mechanisms 400 and 600 advantageously are quite compact, each utilizing three flat plates in face-to-face contact substantially centered on the centerline of the key actuating the switch mechanisms. The plates in the first embodiment are of course the first, fixed plate 410; the second, swingable-reciprocatable plate 414 and the third, purely reciprocatable plate 416. The plates in the second embodiment are of course the first, fixed plate 410; the second, swingable-reciprocatable plate 604 and the third, purely reciprocative plate 602. The second swingable plate 414 and the third purely reciprocatable plate 602 are disposed in the centers of the plate arrays in the first and second embodiments respectively; and these plates are respectively centered on the centerlines B—B and E—E. The springs 482 and 688 in the two embodiments are also centered on these centerlines and on centerlines A—A and D—D so that the springs do not provide any substantial side thrust to the associated key 323 or 323A. The springs 482 and 688 in the two embodiments are advantageously disposed in registering windows in the three plates 410, 414 and 416 in the first embodiment and in the three plates 410, 602 and 604 in the second embodiment, making for compact constructions. The invention may be carried out using either the articulated key 323 shown in the first embodiment or the integral key 323A in the second embodiment. Advantageously, the wedging edges 450 and 452 in the first embodiment hold the swingable auxiliary key 456 from swinging when finger pressure is applied on the tablet surface **534*a* of key 323 for closing the switch 170, and swinging of the key 323A as a unit is prevented in the second embodiment when finger pressure is applied on the central tablet surface 534*a* of key 323A, since the curved edges 618*a* and 62O*a* are disposed above and on opposite sides of the tablet surface 534*a* of the central recess 534 in the key 323A**.

I claim:

1. Finger operated controlling mechanism including an elongate key having a finger thrust surface on which finger pressure can be applied for depressing the key, means for mounting said key so that at least end portions of the key are swingable in unison and so that the key may be depressed under finger force, said mounting means including first, second and third members which are in sliding contact and which are movable with respect to each other, said first member constituting a fixed plate and said third member constituting a plate that is mounted with respect to said first member to be reciprocatable in the direction of a thrust axis normal to said finger thrust surface and said second member being fixed with respect to said swingable end portions of said elongate key and being so mounted that it ma reciprocate in the direction of said thrust axis and may also swing, a force transmitting connection between said elongate key and said second and third members for causing said second and third members and said elongate key to reciprocate together on said thrust axis when said elongate key is depressed while allowing said end portions of said elongate key and said second member to swing, a spring effective on one of said second and third members for returning said second and third members and said elongate key back to original positions after depression of said elongate key and resulting reciprocation of said second and third members, and a pluralit.y of control devices which actuated by said swingable member depending on its swingable disposition when said second and third members are reciprocatively moved on said thrust axis with depression of said key.

2. Finger operated controlling mechanism as set forth in claim 1, said spring being a coiled spring and being mounted on the center line of said key and said plates each being provided with a window formed in it to receive said spring.

3. Finger operated control mechanism including an elongate key having a finger thrust surface on which finger pressure can be applied for depressing the key, means for mounting said key so that at least end portions of the key are swingable in unison and so tnat the key may be depressed under finger force, said mounting means including three plates which are in face-to-face contact and which include a first fixed plate and a third plate which is so mounted with respect to said fixed plate that it may reciprocate in the direction of a thrust axis normal to said finger thrust surface and a second plate fixed with respect to said swingable end portions of said elongate key and so mounted with respect to said first plate that it may reciprocate in the direction of said thrust axis and may also swing, a force transmitting connection between said elongate key and said second and third plates for causing said second and third plates and said elongate key to reciprocate together on said thrust axis when said elongate key is depressed while allowing said end portions of said elongate key and said second plate to swing, a spring effective on one of said second and third plates for returning said second and third plates and said elongate key back to original positions after depression of said elongate key and resulting reciprocation of said second and third plates, and a plurality of control devices which are activated by said swingable plate depending on its swingable disposition when said second and third plates are reciprocatively moved on said thrust axis with depression of said elongate key.

4. Finger operated controlling mechanism as set forth in claim 3, said spring being a coiled spring and being disposed substantially on the centerline of said elongate key, and said three plates having windows which are substantially in register and which receive said coiled spring.

5. Finger operated controlling mechanism as set forth in claim 3, one of said second and third plates being disposed on the central plane of said elongate key and said other two plates being disposed on opposite sides of said one plate and said first plate being bent to have a portion in said plane, said spring being a coiled spring and disposed on the centerline of said elongate key and being effectively between said first plate and said one of said second and third plates which is disposed on the central plane of said elongate key.

6. Finger operated controlling mechanism as set forth in claim 3, one of said second and third plates being disposed on the central plane of said elongate key and said other two plates being disposed on opposite sides of this one plate, said one plate having an abutment edge and a tongue extending from said edge and said first plate having a tongue bent into the central plane of said elongate key and having an abutment edge at the bottom of said tongue, said spring being a coiled spring and being effectively between said abutment edges.

7. Finger operated controlling mechanism as set forth in claim 6, said three plates having windows substantially in register for receiving said coiled spring.

8. Finger operated controlling mechanism as set forth in claim 3, said elongate key being integral end-to-end and said second plate being fixed with respect to said key, said third plate being disposed on the central plane of said elongate key, said force transmitting connection constituting a pair of spaced rounded force receiving edges formed on said third plate and extending into correspondingly rounded cavities on the under surface of said key whereby said key may be depressed adjacent opposite ends to cause said key and said second plate to simultaneously reciprocate and swing and to cause said key and said second plate to reciprocate without swinging movement when finger pressure is applied centrally of the key.

9. Finger operated controlling mechanism as set forth in claim 8, said first and second plates having opposite abustment edtes and said spring being coiled spring and being disposed on the centerline of said elongate key and between said abutment edges provided on said first and second plates.

10. Finger operated controlling mechanism as set forth in claim 9, said third plat being provided with a tongue extending from its said abutment edge and said first plate being provided with a tongue extending from its said abutment edge with said spring surrounding said tongues.

11. Finger operated controlling mechanism as set forth in claim 9, said three plates being provided with windows substantially in register for receiving said spring.

12. Finger operated controlling mechanism as set forth in claim 3, said key being formed by a first, short central auxiliary key and by a second, long auxiliary key having portions on opposite ends of said short auxiliary key, said third plate being fixed with respect to said short auxiliary key and said second plate being fixed with respect to said long auxiliary key and said force transmitting connection constituting a pivotal connection between said second and third plates located adjacent to said short auxiliary key.

13. Finger operated controlling mechanism as set forth in claim 12, said second plate being located substantially on the central plane of said elongate key and said first and third plates being located on opposite sides of said second plate, and abutment edges provided on said first and second plates and said spring constituting a coiled spring disposed effectively between said edges.

14. Finger operated controlling mechanism as set forth in claim 12, said second plate being disposed on the central plane of said elongate key and said first and third plates being disposed on opposite sides of said second plate, abutment edges provided on said first and second plates, said spring constituting a coiled spring and disposed effectively between said abutment edges, and tongues extending toward each other and disposed on said abutment edges and within said spring.

15. Finger operated controlling mechanism as set forth in claim 12, said pivotal connection including a cylindrical shaft portion extending through said second and third plates and fixed with respect to one of said second and third plates, and diverging edges formed on the other one of said second and third plates and gripping said shaft portion when depressive force is applied onto said short auxiliary key for holding said third plate and thereby said long auxillary key against swinging movement.

16. Finger operated controlling mechanism as set forth in claim 12, said pivotal connection being provided by a headed rivet having a cylindrical shaft portion and extending through said second and third plates and being fixed with respect to said second plate, and diverging gripping edges provided in said third plate for gripping said cylindrical shaft portion for thereby holding said second plate and thereby said long auxiliary key. from swinging when depressive force is applied onto said short auxiliary key.

17. Finger operated controlling mechanism including an elongate key having a finger thrust surface on which finger pressure can be applied for depressing the key being formed by a first short central auxiliary key and by a second long auxiliary key having portions on opposite ends of said short auxiliary key, one member for mounting said short auxiliary key and fixed thereto and constrained to have reciprocative movement in the direction of a thrust axis normal to the finger thrust surface on said elongate key and another member for mounting said long auxiliary key and fixed thereto and mounted to be moveable reciprocatively in the direction of said thrust axis and also to be swingable, a connection between said members for causing said members and thereby siad auxiliary keys to reciprocate together and the said connection being pivotable to allow said other member to swing, a plurality of control devices actuated selectively by said swingable member depending upon its swingable disposition when said two members are reciprocated with depression of said elongate key, and a spring means effective on one of said members for returning said members and said elongate key back to original positions when finger pressure is released from said elongae key after depression thereof, said connection including means responsive to finger pressure on said short auxiliary key to restrain said other member and said long auxiliary key from swinging when finger pressure is applied on said short auxiliary key to depress the short auxiliary key.

18. Finger operated controlling mechanism as set forth in claim 17, said connection including a rivet extending through said two members and located adjacent to and below said short central auxiliary key.

19. Finger operated controlling mechanism as set forth in claim 17, said connection including a cylindrical shaft portion extending through said two members and being fixed with respect to one of said members, said other member being provided with diverging gripping edges effective on said shaft portion and gripping the shaft portion when downward pressure is applied onto said short auxiliary key for thereby holding said long auxiliary key against swinging movement when depressive force is applied to said short auxiliary key.

20. Finger operated controlling mechanism as set forth in claim 17, said connection including a headed rivet having a cylindrical shaft portion that extends through said two members and being fixed with respect to said other member and a pair of diverging gripping edges formed in said one member and adapted to grip said cylindrical shaft portion when said short auxiliary key has depressive force applied to it for thereby holding said other member and said long auxiliary key against swinging movement when depressive force is applied onto said short auxiliary key.

21. Finger operated controlling mechanism including a finger thrust surface on which finger pressure can be applied for depressing the key, said key being formed by a short central auxiliary key and by a second long auxiliary key having portions on opposite ends of said short auxiliary key, one member for mounting said short auxiliary key and fixed thereto and constrained to have reciprocative movement in the direction of a thrust axis normal to the finger thrust surface on said elongate key and another member for mounting said long auxiliary key and fixed thereto and mounted to be moveable receiprocatively in the direction fo said thrust axis and also to be swingable, a connection between said members for causing said members and thereby said auxiliary keys to reciprocate together and the said connection being pivotable to allow said other member to swing, a plurality of control devices actuated selectively by said swingable member depending upon its swingable disposition when said two members are reciprocated with depression of said elongate key, and a spring means effective on one of said members for returning said members and said elongate key back to original positions when finger pressure is released from said elongate key after depression thereof, siad short auxiliary key being provided with external cylindrical bearing surfaces ad said long auxiliary key being provided with internal cylindrical bearing surfaces contacting and cooperating wit the external cylindrical surfaces to allow swinging movement of said long auxiliary key about the center of the pivot of said connection.

22. An elongate key for finger operated devices having first, second and third adjoining finger receiving recesses on the top finger thrust surface of the key with said recesses being disposed on the longitudinal center line of this surface with said second recess being in the center and said first and third recesses being on the ends, said key being formed by a first short central auxiliary key having said second recess therein and by a second long auxiliary key having portions on opposite ends of said short auxiliary key and having said first and third recesses therein, said key including a pivotal connection for connecting said long auxiliary key with said short auxiliary key and external bearing surfaces on the opposite ends of said short auxiliary key and internal cylindrical bearing surfaces on said long auxiliary key in a bearing relationship with respect to said external cylindrical surfaces and all of said cylindrical surfaces having the center of said pivotal connection as their centers.

23. An elongate key as set forth in claim 22, said key having upstanding ridges defining the adjoining edges of said recesses, and said cylindrical surfaces terminating on said ridges.

24. An elongate key as set forth in claim 23, the elongate key also having a longitudinally extending trough which has the bottoms of said recesses also as the bottom of the trough, said recesses and said ridges being below the side edges of said trough so that the trough is continuous end-to-end of the elongatae key.

* * * * *